US005137149A

United States Patent [19]

Polacek

[11] Patent Number: 5,137,149

[45] Date of Patent: Aug. 11, 1992

[54] HANG-UP STORAGE DEVICE FOR APPAREL BELTS

[76] Inventor: Mary Z. Polacek, 3063 Bayshore, Ventura, Calif. 93001

[21] Appl. No.: 581,367

[22] Filed: Sep. 12, 1990

[51] Int. Cl.[5] ..... B65D 85/18

[52] U.S. Cl. ..... 206/278; 206/293; 211/113; 223/87

[58] Field of Search ..... 206/278, 292, 293, 296, 206/493, 295; 211/60.1, 113, 119; 223/87, 88, 90, 85; D6/315

[56] References Cited

U.S. PATENT DOCUMENTS

| | | | |
|---|---|---|---|
| 1,410,925 | 3/1922 | Kempton | 206/278 |
| 2,598,614 | 5/1952 | Gilbert | 211/113 |
| 2,659,643 | 11/1953 | Friesz | 206/292 X |
| 2,793,762 | 5/1957 | Broussard | 211/113 |
| 2,895,521 | 7/1959 | Weber | 206/292 |
| 3,028,013 | 4/1962 | Cotey | 206/278 X |
| 3,028,974 | 4/1962 | Loeb | D6/326 X |
| 3,710,996 | 1/1973 | Smilow et al. | 223/87 |
| 3,783,995 | 1/1974 | Tobin | 211/113 X |
| 3,967,766 | 7/1976 | Hart | 211/119 X |
| 4,063,669 | 12/1977 | Smilow et al. | 223/87 |
| 4,714,156 | 12/1987 | Kolton et al. | 206/296 |
| 4,799,587 | 1/1989 | DeSanto | 206/37.6 |
| 4,811,852 | 3/1989 | Kelly | 211/119 |
| 4,874,100 | 10/1989 | Smagula | 211/60.1 |
| 4,940,146 | 7/1990 | Kolton et al. | 211/113 X |
| 4,947,987 | 8/1990 | Keenan | 206/292 |

*Primary Examiner*—Bryon P. Gehman
*Attorney, Agent, or Firm*—Milton S. Gerstein

[57] ABSTRACT

A storage unit for belts has a pair of belt-mounting fabric-flaps on the exterior surfaces of which are mounted a series of belt-holders. Each exterior surface has a pair of elongated mounting strips forming a first one of a hook-and-pile fastener, with the other of the hook-and-pile fastener being constituted by a series of bands each having a first end fixedly secured to a respective strip, with the other end of each band being free for selected closure on the strip, whereby a releasable loop may be formed by each band for containing a belt-buckle, whereby the belt thereof may hang, or suspended, freely. The series of releasable bands are provided in varying lengths so that belts and buckles of belts of differing sizes, weights, and girth may be accommodated. The two flaps receive therebetween the horizontal member of a conventional clothes hanger by which the unit may be hung in a closet, or the like. The unit also has a pair of cover flaps covering over the belt-mounting fabric-flaps for aesthetic purposes, and for preventing accidental opening of the loop-bands.

12 Claims, 2 Drawing Sheets

FIG 1
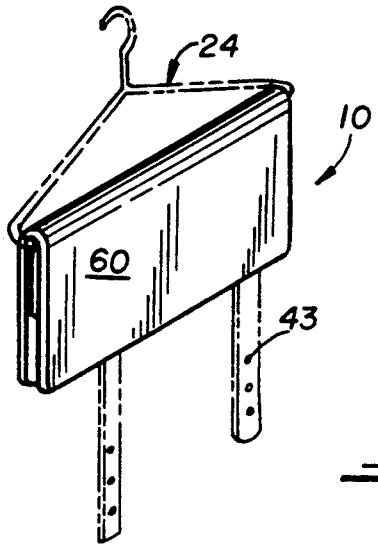
FIG 2
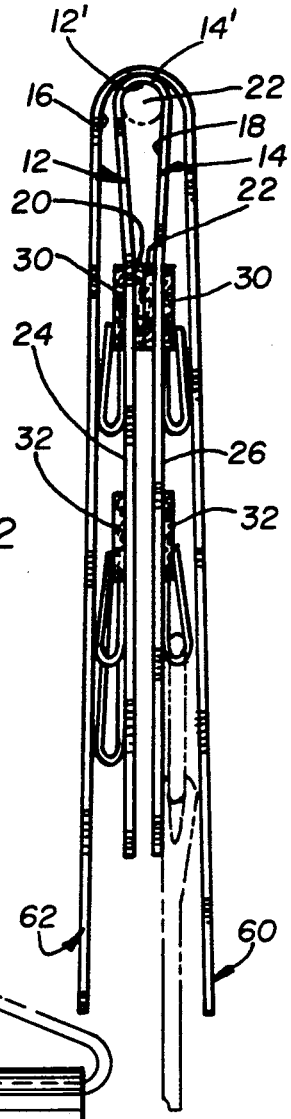
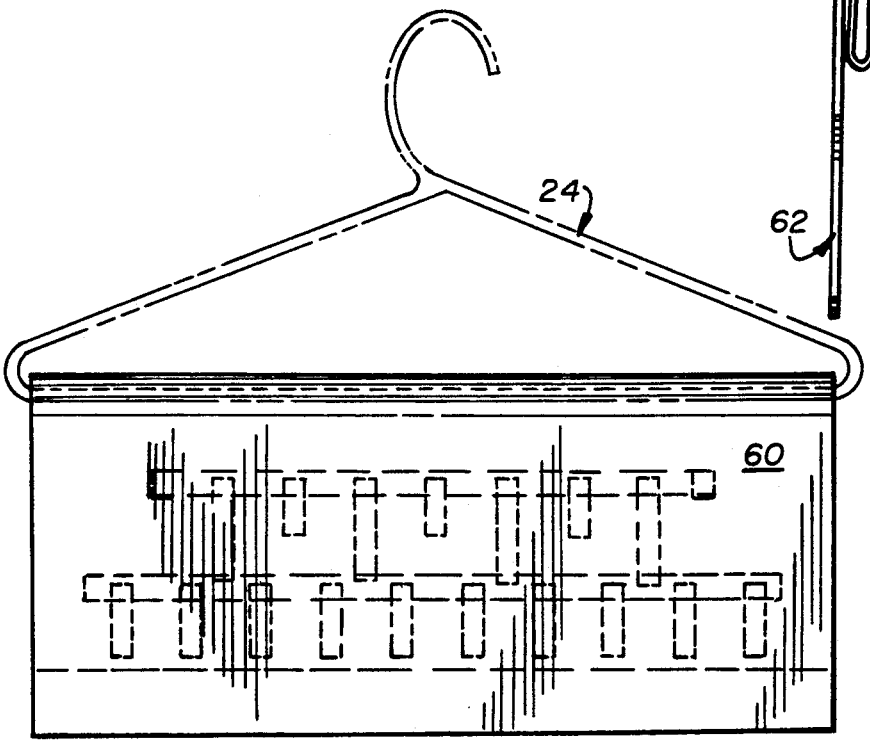
FIG 3

HANG-UP STORAGE DEVICE FOR APPAREL BELTS

BACKGROUND OF THE INVENTION

The present invention is directed to a storage unit for apparel belts, by which different sizes and shapes of belts may be removably stored and easily accessed and removed when needed. The present invention is designed to allow for the storing of all of one's belts at one location and in one unit, with each belt being easily seen in order to choose the desired one to wear.

SUMMARY OF THE INVENTION

It is the primary objective of the present invention to provide a storage unit for men's, women's, or children's wearing belts, for storing all of one's belts in one easily and readily accessible location.

It is another objective of the invention to provide such a storage unit for belts that can accommodate belts of varying sizes and belts of differently-sized buckles, or the like.

It is yet another objective of the invention to provide such a storage unit for belts that may removably supported by a clothes hanger for selectively hanging the storage unit in a closet.

Toward these and other ends, the belt-storage unit of the invention has a pair of belt-mounting fabric-flaps on the exterior surfaces of which are mounted a series of belt-holders. In the preferred form of the invention, each exterior surface has a pair of elongated mounting strips forming a first one of a hook-and-pile fastener, with the other of the hook-and-pile fastener being constituted by a series of bands each having a first end fixedly secured to a respective strip, with the other end of each band being free for selected closure on the strip, whereby a releasable loop may be formed by each band for containing a belt-buckle, whereby the belt thereof may hang, or suspended, freely. The series of releasable bands are provided in varying lengths so that belts and buckles of belts of differing sizes, weights, and girth may be accommodated.

The two flaps receive therebetween the horizontal member of a conventional clothes hanger by which the unit may be hung in a closet, or the like. Cooperating fasteners provided on the interior surfaces of the flaps removably secure the unit to the hanger. The unit also has a pair of cover flaps covering over the belt-mounting fabric-flaps for aesthetic purposes, and for preventing accidental opening of the loop-bands.

BRIEF DESCRIPTION OF THE INVENTION

The invention will be more readily understood with reference to the accompanying drawing, wherein:

FIG. 1 is a perspective view showing the belt-storage unit of the invention suspended from a clothes-hanger;

FIG. 2 is a side elevational view thereof;

FIG. 3 is a front view thereof;

DETAILED DESCRIPTION OF THE INVENTION

Figure 4:
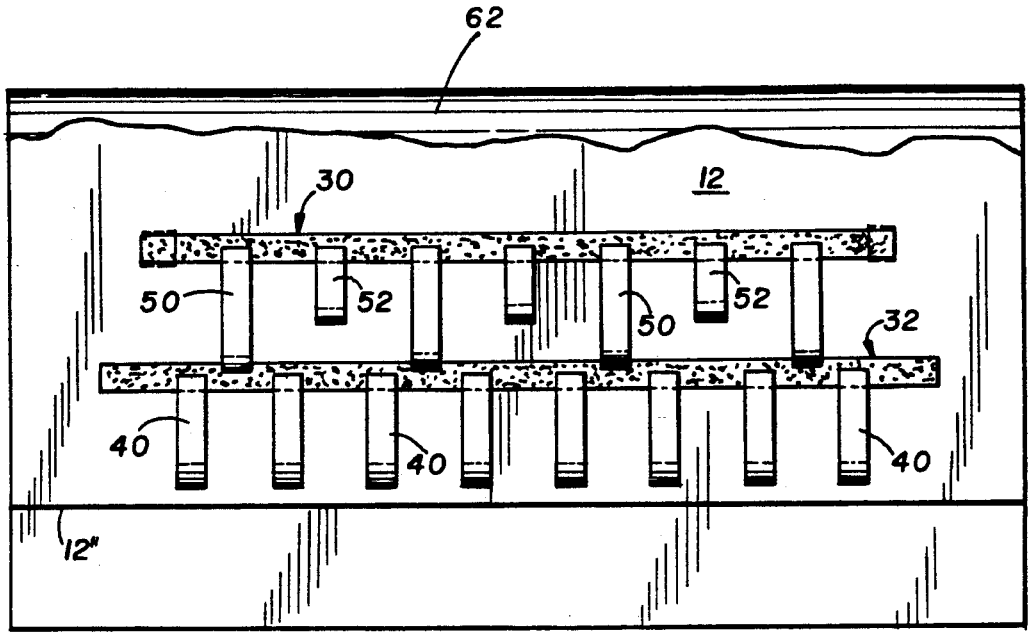
FIG. 4 is a front view with the front cover-flap pivoted away to show the individual belt-holding loop-bands.
Figure 5:
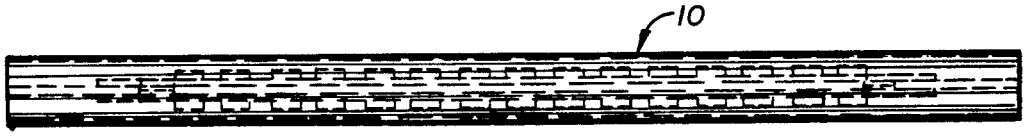
FIG. 5 is a top view.
Figure 6:
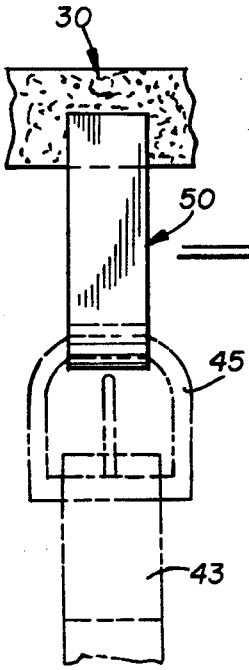
FIG. 6 is a detail view showing a belt-holding loop-band holding a buckle of a belt, whereby the belt is suspended.
Figure 7:
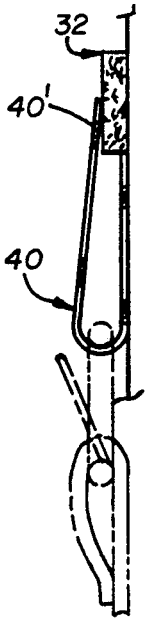
FIG. 7 is a side elevational view thereof.

Referring now to the drawings in greater detail, the belt-storage unit of the invention is indicated generally by reference numeral 10. The unit 10 has a first pair of inner, or interior, belt-mounting flaps 12, 14, which are sewn, or otherwise permanently connected, together at their mutually-adjoining upper edges 12', 14'. Each flap 12, 14 is made of suitable fabric or material providing sufficient stiffness so as to provide a firm mounting surface. In the preferred embodiment, each flap 12, 14 is a double layer of fabric to provide increased stiffness for better support-capabilities. What is important is that the two flaps 12 and 14 be joined along common edge surfaces so that the flaps may hang downwardly and pivot relative to each about the common edge-joinder. One single piece of material may be employed to provide the flaps 12, 14 with appropriate doubling over and folds made therein to achieved the desired, pivotal-flaps arrangement.

Each flap 12, 14 defines an interior surface face 16, 18 which mount cooperating hook-and-pile fasteners halves 20, 22, by which the two flaps 12, 14 may be removably secured to each for securing the unit 10 to the horizontal bar 22 of a conventional clothes-hanger 24 shown in dotted lines in FIGS. 1–3, by which the unit 10 is suspended in a closet, for easy and ready access thereto.

Each flap 12, 14 also has an exterior, or outer, surface 26, 28, respectively, to which are fixedly secured a pair of mounting strips 30, 32. The strips 30, 32 are arranged horizontally on each respective surface, and are parallel to each other, with the strip 30 being the upper one. Each strip 30, 32 defines an outer surface, as seen in FIG. 4, that comprises the pile-portion of a hook-and-pile fastener. Operatively associated with each strip 30, 32 are a plurality of spaced-apart belt-suspending loops or bands. The bands 40 associated with the lower strip 32 are all substantially of the same length, with one end of each band 40 being sewn, or otherwise permanently secured, to the strip 40, and/or directly sewn to the fabric-flap 12, 14. The other end 40' of each loop or band 40 is removably securable to the strip 32 owing to the fact that the exterior surfaces of these bands—as viewed when the bands are allowed to hang downwardly in their disconnected, suspended state—have the mating hook-portions of a hook-and-pile fastener that mate with the pile-portion fabric of the strip 32. This entire exterior surface of each band 40 is provided with the hook portion of the hook-and-pile fastener, so that any desired end or intermediate portion of the band 40 may be removably secured to the strip 32, whereby loops of varying diameters or sizes may be formed for accommodating belt-buckles, or the like, of different sizes and dimensions. Generally, since the bands 40 are of the same length, standard-sized belts are suspended from these loop-bands 40.

The upper strip 30 is provided with bands similar to the bands 40 of the lower strip 32, with the exception that the bands associated with the upper strip 30 are provided in varying lengths in order to accommodate belts 43 and belt-buckles 45 of different sizes and dimensions. In the preferred embodiment, first bands or loops 50 are provided that are of relatively greater length for accommodating large belt-buckles, while second bands 52 of relatively shorter length than the bands 50 are interspersed between the larger bands 50 in an alternating sequence, as clearly shown in FIG. 4. Preferably the bands 52 are of the same length as the bands 40. Like the bands 40, the bands 50 and 52 define exterior surfaces of the hook-portion of the hook-and-pile fastener for removable closure onto the strip 30 at any portion of the length of the band 50, 52 desired, to create loops of varying diameter or size. The bands 50, when opened and allowed to hang downwardly, may have a length such that its removable or free end 50' extends considerably below the lower edge surface 12" of the respective flap, whereby very large belt-buckles may be accommodated. The lower loop-bands 40 are generally horizontally offset or staggered with respect to the upper loop-bands 50, 52, as seen in FIG. 4, to allow the belts suspended from the upper loop-bands 50, 52 to be unobstructed by the belts suspended from the lower loop-bands 40.

The unit 10 also has a pair of outer cover-flaps or surfaces 60, 62 that drape over the inner flaps 12, 14. Each outer cover-flap has a length greater than the inner flaps 12, 14, so that the cover-flaps 60, 62 overlap and project beyond the inner flaps, as seen in FIGS. 1 and 2. These outer flaps 60, 62 provide an aesthetic effect and hide from view the belt-buckles and loop-bands 40, 50, 52, while the belts proper extend downwardly between them. The cover-flaps 60, 62 also serve the purpose of preventing the accidental opening of the loop-bands 40, 50, 52, as might occur by one's hand reaching into the closet and accidentally rubbing against one or more of the removable ends of the loop-bands 40, 50, 52.

While a specific embodiment of the invention has been shown and described, it is to be understood that numerous changes and modifications may be made therein without departing from the scope, spirit and intent of the invention as set forth in the appended claims.

What I claim is:

1. A storage unit for belts comprising:

a first supporting surface;

a second supporting surface connected to said first supporting surface, each of first and second supporting surfaces comprising an inner surface and an outer surface, said inner surfaces facing each other;

each of said outer surfaces comprising a plurality of belt-suspending means by which belts may be suspended therefrom;

each of said plurality of belt-suspending means comprising at least one mounting strip secured to a respective said outer surface, each said mounting strip having an exterior surface comprising one half of a hook-and pile fastener, and a series of bands, each of said bands having a first end operatively connected to said at least one mounting strip, and a second free end, each of said bands having a surface-portion comprising the other half of a hook-and-pile fastener for selective and removable attachment of said second free end to said at least one mounting strip.

2. The belt-storage unit according to claim 1, wherein said first and second supporting surfaces are pivotally movable with respect to each other.

3. The belt-storage unit according to claim 2, further comprising hanger means for suspending said first and second supporting surfaces in a closet, said hanger means comprising a horizontal rod; said horizontal rod supporting thereon said pivotally-connected portions of said first and second supporting surfaces.

4. The belt-storage unit according to claim 2, further comprising a first cover flap and a second cover flap for covering said first and second supporting surfaces, respectively, said first cover flap being draped over said first supporting surface, and said second cover flap being draped over said second supporting surface; said first and second cover flaps being pivotally connected to each along common edges thereof.

5. The belt-storage unit according to claim 1, wherein each of said plurality of belt-suspending means comprises at least one mounting strip secured to a respective said outer surface and having an outer surface comprising one half of a hook-and-pile fastener means, and a series of bands, each said band having a first end operatively connected to said at least one mounting strip, and a second end free, each said band having an outer surface at least a portion of which comprises the other half of a hook-and-pile fastener means for selective and removable attachment of said free end to said at least one mounting strip.

6. The belt-storage unit according to claim 1, wherein each of said plurality of belt-suspending means comprises a pair of mounting strips, and a plurality of said bands for each of said mounting strips; said mounting strips of each said outer surface being horizontally parallel to each other to define an upper mounting strip and a lower mounting strip.

7. The belt-storage unit according to claim 6, wherein said plurality of bands operatively associated with said upper mounting strip comprise first ones of relatively shorter length, and second ones of relatively longer length; said first ones and said second ones being arranged in an alternating sequence.

8. The belt-storage unit according to claim 7, wherein said plurality of bands operatively associated with said lower mounting strip are horizontally staggered with respect to said plurality of bands of said upper mounting strip so that belts suspended from said bands of said upper mounting strip are not obstructed by belts suspended from the bands of the lower mounting strip.

9. The belt-storage unit according to claim 1, wherein said plurality of bands comprise first ones of relatively shorter length, and second ones of relatively longer length; said first and second ones being arranged in an alternating sequence along a respective one of said mounting strips.

10. The belt-storage unit according to claim 1, further comprising hanger means for suspending said first and second supporting surfaces in a closet, said hanger means comprising a horizontal rod; said horizontal rod supporting thereon the portions of said first and second supporting surfaces connected to each other.

11. The belt-storage unit according to claim 10, wherein said inner surfaces comprise cooperating closure means for removably securing said inner surfaces together, whereby the first and second supporting surfaces are removably secured to said horizontal rod of said hanger means.

12. The belt-storage unit according to claim 1, further comprising a first cover flap and a second cover flap for covering said first and second supporting surfaces, respectively, said first cover flap being draped over said first supporting surface, and said second cover flap being draped over said second supporting surface.

* * * * *